US011804681B1

(12) United States Patent
Shu

(10) Patent No.: US 11,804,681 B1
(45) Date of Patent: Oct. 31, 2023

(54) WAVEGUIDE TO COAXIAL CONDUCTOR PIN CONNECTOR

(71) Applicant: SAGE Millimeter, Inc., Torrance, CA (US)

(72) Inventor: Yonghui Shu, Rolling Hills Estates, CA (US)

(73) Assignee: SAGE Millimeter, Inc., Torrance, CA (US)

( * ) Notice: Subject to any disclaimer, the term of this patent is extended or adjusted under 35 U.S.C. 154(b) by 444 days.

(21) Appl. No.: 16/878,955

(22) Filed: May 20, 2020

Related U.S. Application Data

(60) Provisional application No. 62/854,873, filed on May 30, 2019.

(51) Int. Cl.

| | |
|---|---|
| ***H01R 24/44*** | (2011.01) |
| ***H01P 3/06*** | (2006.01) |
| ***H01P 5/08*** | (2006.01) |
| ***H01P 3/12*** | (2006.01) |
| ***H01P 1/00*** | (2006.01) |
| ***H01R 13/719*** | (2011.01) |
| ***H01P 11/00*** | (2006.01) |
| ***H01R 103/00*** | (2006.01) |

(52) U.S. Cl.
CPC ..... *H01R 24/44* (2013.01); *H01P 1/00* (2013.01); *H01P 3/06* (2013.01); *H01P 3/12* (2013.01); *H01P 5/08* (2013.01); *H01P 11/00* (2013.01); *H01R 13/719* (2013.01); *H01R 2103/00* (2013.01)

(58) Field of Classification Search
CPC ... H01R 24/44; H01R 13/719; H01R 2103/00; H01P 1/00; H01P 3/06; H01P 3/12; H01P 5/08; H01P 11/00
See application file for complete search history.

(56) References Cited

U.S. PATENT DOCUMENTS

| | | | | |
|---|---|---|---|---|
| 3,594,663 | A * | 7/1971 | Allen | H01P 5/12 333/135 |
| 3,737,812 | A * | 6/1973 | Gaudio et al. | H01P 5/103 333/32 |
| 4,409,566 | A * | 10/1983 | Patton et al. | H01P 5/103 333/34 |
| 7,625,131 | B2* | 12/2009 | Zienkewicz et al. | H01P 5/085 385/88 |

FOREIGN PATENT DOCUMENTS

| | | | | |
|---|---|---|---|---|
| WO | 2016186136 | A1* | 11/2016 | H01P 3/06 |

OTHER PUBLICATIONS

Microwave Journal, Compact Waveguide-to-Coaxial Transition, Aug. 13, 2014.

* cited by examiner

*Primary Examiner* — Hafizur Rahman
*Assistant Examiner* — Kimberly E Glenn
(74) *Attorney, Agent, or Firm* — Van Pelt, Yi & James LLP

(57) ABSTRACT

Connecting a waveguide and a coaxial conductor pin is disclosed. In an embodiment, a connector includes: a body, wherein the body includes a first interface configured to couple to the waveguide and a second interface configured to couple to the coaxial conductor pin; a cavity within the body, wherein the cavity takes up a region between the first interface and the second interface; and an impedance transformation structure located in the cavity.

16 Claims, 12 Drawing Sheets

WAVEGUIDE TO COAXIAL CONDUCTOR PIN CONNECTOR

CROSS REFERENCE TO OTHER APPLICATIONS

This application claims priority to U.S. Provisional Pat. Application No. 62/854,873 entitled WAVEGUIDE CONNECTOR filed May 30, 2019 which is incorporated herein by reference for all purposes.

BACKGROUND OF THE INVENTION

Radio-Frequency (RF) engineering involves the design and application of devices that produce or utilize signals within the radio band, a frequency range that extends from approximately 20 kilohertz (kHz) up to 300 gigahertz (GHz). In RF engineering, waveguides are structures (typically hollow conductive pipes) that are utilized to guide and transmit electromagnetic waves with minimal loss of energy by restricting the transmission of energy to one direction. Coaxial lines, which are also utilized in RF engineering, have an inner conductor that is separated from a surrounding concentric conducting shield by an insulating material. In various scenarios, a waveguide to coaxial connection must be made (specifically, connecting a waveguide to a coaxial conductor pin). Performing this type of connection can be cumbersome, costly and/or involve transmission loss. Thus, it would be beneficial to develop techniques directed toward improving connections between waveguide and coaxial components.

BRIEF DESCRIPTION OF THE DRAWINGS

Various embodiments of the invention are disclosed in the following detailed description and the accompanying drawings.

DETAILED DESCRIPTION

Figure 1:
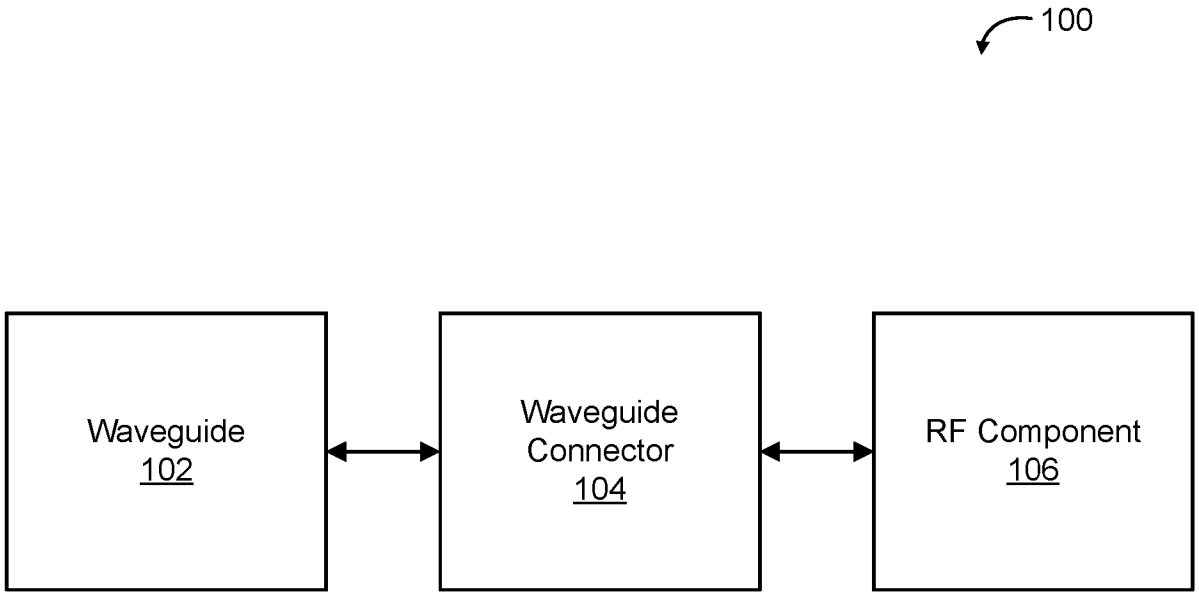
FIG. 1 is a block diagram illustrating an embodiment of a system utilizing a waveguide to coaxial connection.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

A connector for connecting a waveguide and a coaxial conductor pin is disclosed. The disclosed connector comprises: a body, wherein the body includes a first interface configured to couple to the waveguide and a second interface configured to couple to the coaxial conductor pin; a cavity within the body, wherein the cavity takes up a region between the first interface and the second interface; and an impedance transformation structure located in the cavity. Practical and technological advantages of the disclosed connector over traditional approaches to interfacing waveguides and coaxial lines include, as described in further detail below, reduced signal loss, less physical space taken up by the connector, lower financial cost, increased design flexibility and decreased inventory management. The disclosed connector may be referred to herein as a waveguide to coaxial conductor pin connector, a waveguide to coaxial connector, a waveguide connector, or simply a connector.

Waveguides, along with coaxial lines, are commonly used transmission media in modern RF components, sub-assemblies, and systems. As used herein, RF refers to an electromagnetic frequency range that extends from approximately 20 kHz up to 300 GHz, which includes microwave and millimeter-wave frequency ranges. As used herein, a waveguide refers to a structure (e.g., a hollow conductive metal pipe) that guides and transmits RF waves with minimal loss of energy by restricting the transmission of energy to one direction. As used herein, a coaxial line refers to a structure for carrying electromagnetic signals, wherein the structure has an inner conductor that is separated from a surrounding concentric conducting shield by a dielectric (insulating) material. As used herein, a coaxial conductor pin refers to a portion of the inner conductor of the coaxial line that is exposed and configured to interface with a waveguide to coaxial connector. The coaxial conductor pin may also be a part of a RF component (e.g., a RF electronic amplifier, or a frequency converter) that is to be interfaced with the waveguide to coaxial connector. The functionality described herein to connect to a coaxial conductor pin also includes the functionality to connect to a coaxial line or an RF component with a coaxial interface. As used herein, connecting a waveguide to a coaxial conductor pin, coaxial line, or coaxial component refers to transmitting an electromagnetic signal between the coaxial conductor pin, coaxial line, or coaxial component and the waveguide. In various embodiments, a waveguide to coaxial connector that is utilized to connect the waveguide to a coaxial conductor pin, coaxial line, or coaxial component is in physical contact with both the waveguide and the coaxial conductor pin, coaxial line, or coaxial component.

Typically, due to a metal pipe configuration, waveguides are heavier and bulkier than coaxial lines, especially at low microwave frequencies. However, waveguides typically offer better performance with respect to transmitting high power with lower loss. Waveguides are widely used in millimeter-wave bands where loss is a more critical parameter. Waveguide-interfaced components are required in various scenarios due to high performance, high power handling, and/or system integration requirements. For example, for some applications, a waveguide connection to an antenna, amplifier, frequency converter, switch, attenuator, oscillator, etc. may be needed. Stated alternatively, in some applications, due to performance requirements, it may be desired that one or more of the abovementioned components be connected to a waveguide instead of a coaxial line (e.g., a waveguide may be utilized to connect an amplifier to an antenna in order to minimize signal loss between the amplifier and the antenna). Many RF components (e.g., antennas, amplifiers, frequency converters, switches, attenuators, oscillators, etc.) have standardized ports (e.g., industry standard ports) that allow the components to be connected to a coaxial connector, which in turn can be connected to a coaxial line. For some applications, due to performance requirements, it would be technologically beneficial to use a waveguide instead of a coaxial line. Thus, there is a technological benefit to utilizing a structure that is able to connect to a standardized port on one end (e.g., a standard coaxial connection, such as N, SMA (Sub-Miniature Version A), 2.92 mm (K), 2.4 mm, 1.85 mm (V), 1.35 mm, 1 mm, etc.) and also able to connect to a waveguide on the other end.

FIG. 1 is a block diagram illustrating an embodiment of a system utilizing a waveguide to coaxial connection. In system 100, waveguide 102 is connected via waveguide connector 104 to RF component 106. Examples of waveguide 102 include rectangular waveguides, circular waveguides, elliptical waveguides, single-ridge waveguides, double-ridge waveguides, or any other type of waveguide. Examples of RF component 106 include antennas, amplifiers, frequency converters, switches, attenuators, oscillators, or any other type of component. In various embodiments, waveguide connector 104 connects waveguide 102 and RF component 106 by utilizing a body that includes a first interface configured to couple to waveguide 102 and a second interface configured to couple to a port of RF component 106. In various embodiments, the port of RF component 106 includes a coaxial conductor pin to which waveguide connector 104 is configured to couple.

Utilizing waveguide connector 104 to connect waveguide 102 to RF component 106 has technological advantages over other connection approaches. For example, there are advantages over connecting a coaxial connector to RF component 106 and then connecting a coaxial-to-waveguide adapter to the coaxial connector to connect to waveguide 102. One advantage is fewer interface parts needed to connect waveguide 102 and RF component 106, which reduces circuit signal loss, bulkiness, and financial cost. As another example, there are also advantages over using an RF component dedicated package with a built-in transition to directly connect a waveguide. One advantage is being able to connect to a standardized port of the RF component, which avoids the time and cost of custom designing and manufacturing the RF component to have the built-in transition. Using waveguide connector 104 means the RF component does not need a dedicated component housing. Furthermore, the waveguide connector approach enhances system flexibility because different types of waveguide connectors can be utilized (e.g., swapped in and out), thus allowing for different types of waveguides to be connected to RF component 106, which is not possible if a specific type of transition is custom built into RF component 106. Waveguide connector 104 is a field replaceable waveguide connector, which can be used to directly replace a field replaceable coaxial connector. For example, waveguide connector 104 is field replaceable when a glass bead is used to surround a conductor pin. Waveguide connector 104 may be designed for glass beads with pin diameters of 9, 15, 20, 50, etc. mils (1 mil = 1 thousandth of an inch) and various mounting configurations to cover all standard waveguide bands from 8.2 to 110 GHz. In various embodiments, waveguide connector 104 is a hermetical waveguide solution. For example, waveguide connector 104 can couple to a conductor pin with a glass bead hermetically soldered into a housing wall of RF component 106. Thus, if a package is designed and manufactured to be hermetically sealed for coaxial connectors, it retains its hermeticity when coupling to waveguide connector 104, which eliminates the need for an expensive hermetic waveguide process.

Waveguide connector 104 may be coupled to either an input or an output of an RF component. The input may be a coaxial or waveguide connection and the output may also be a coaxial or waveguide connection. Waveguide connector 104 can be used regardless of the connection types for the input and output of the RF component because waveguide connector 104 includes an interface for making coaxial connections as well as another interface for making waveguide connections. In some embodiments, a plurality of RF components and/or waveguides in a system are connected together using a plurality of waveguide connectors. In some embodiments, waveguide connector 104 is attached to RF component 106 with screws, pins, or other fastening components through mounting holes. Mounting hole positions may conform to industry standard positions, e.g., mounting holes that are 0.48 inches apart.

FIGS. 2A - 2F are diagrams depicting various views of an embodiment of a waveguide to coaxial conductor pin connector. The waveguide connector illustrated in FIGS. 2A - 2F may be utilized in system 100 as waveguide connector 104 to connect waveguide 102 to RF component 106.

Figure 2A:
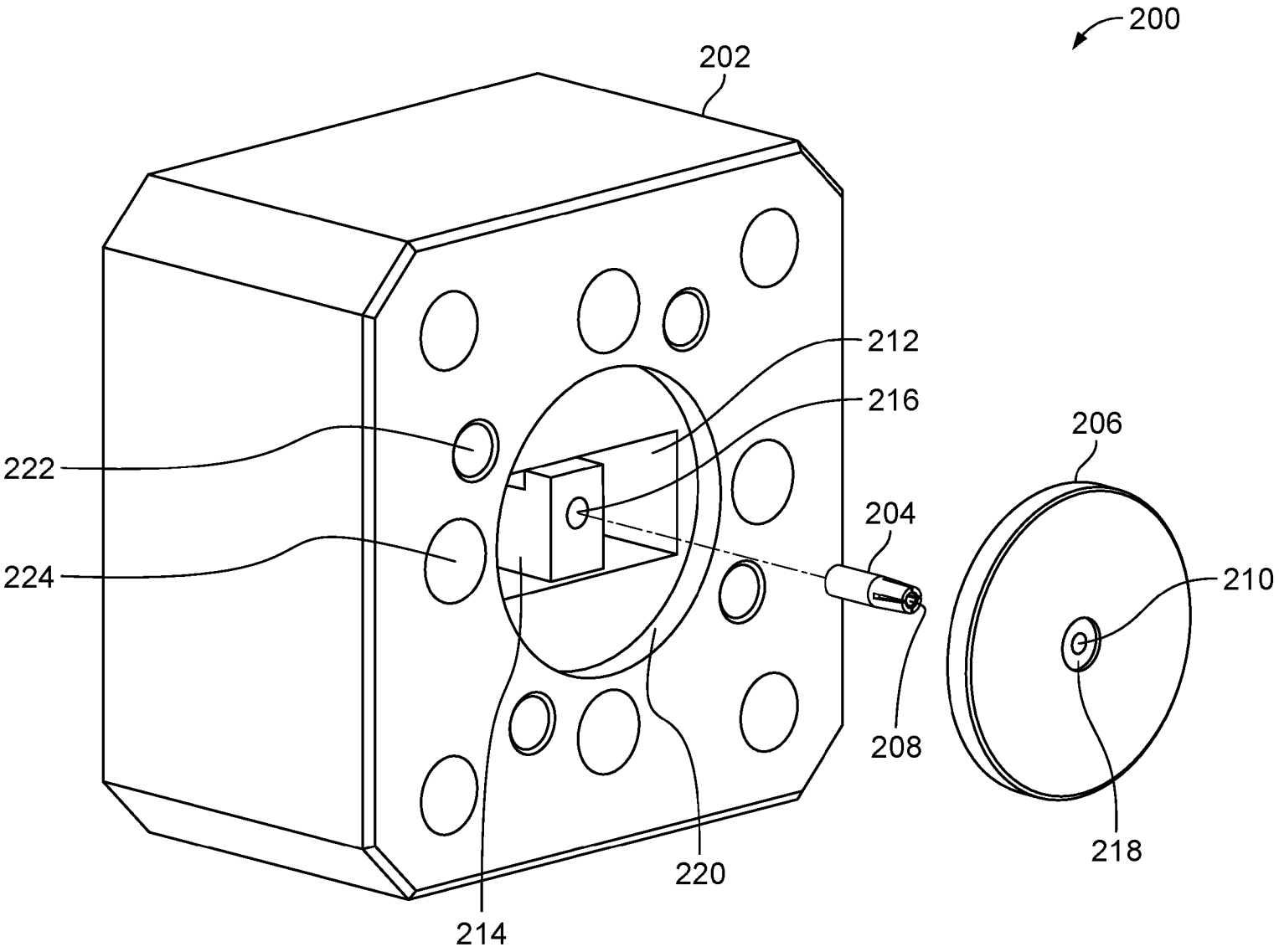
FIGS. 2A - 2F are diagrams depicting various views of an embodiment of a waveguide to coaxial conductor pin connector.

FIG. 2A is a three-dimensional exploded view diagram of waveguide connector 200. In the example illustrated, waveguide connector 200 includes body 202, receptacle component 204, and back short component 206. In some embodiments, receptacle component 204 and back short component 206 are fitted into body 202. For example, receptacle component 204 and back short component 206 may be press fitted (also known as interference fitted or friction fitted) into body 202 to make waveguide connector 200. Receptacle component 204 has opening 208 into which a coaxial conductor pin can be inserted. Back short component 206 has aperture 210 through which the coaxial conductor pin can pass. In various embodiments, opening 208 and aperture 210 are aligned with respect to their centers. Creation of waveguide connector 200 is not limited to fitting components together. The example given is merely illustrative. It is also possible to construct waveguide connector as one solid piece with a receptacle component and back short component included as the fabrication process. Fabrication of waveguide connector 200 may also vary in various other aspects for various embodiments of waveguide connector 200.

In some embodiments, body 202 is made at least in part with aluminum. In some embodiments, receptacle component 204 is made at least in part with beryllium copper. In some embodiments, back short component 206 is made at least in part with aluminum. Body 202, receptacle component 204, and back short component 206 may be gold-plated. These example materials are merely illustrative. It is also possible to use other materials, such as other durable metals, to make body 202, receptacle component 204, and/or back short component 206. For example, body 202 may be made at least in part with brass.

Waveguide connector 200 is configured to couple to a port (e.g., a standardized port) of an RF component (e.g., an antenna, amplifier, frequency converter, switch, attenuator, oscillator, etc.). In various embodiments, the standardized port includes a conductor pin of a standard glass bead, the glass bead being an insulating dielectric material in which the conductor pin is embedded. A conductor pin of a glass bead is a common and standardized way for RF components to interface with standardized field replaceable connectors (e.g., N, SMA, 2.92 mm (K), 2.4 mm, 1.85 mm (V), 1.35 mm, 1 mm, etc.). The conductor pin has various standard diameters (e.g., 0.009 inches, 0.012 inches, 0.015 inches, 0.020 inches, 0.050 inches, etc.) The conductor pin connects to waveguide connector 200 via insertion into receptacle component 204. Thus, receptacle component 204 and back short component 206 comprise an interface that is configured to couple to a coaxial conductor pin. In the example shown, on body 202, the side opposite the side on which receptacle component 204 and back short component 206 are located is an interface configured to couple to a waveguide.

In the example illustrated, body 202 includes cavity 212. Cavity 212 occupies a region between the waveguide interface and the coaxial conductor pin interface of body 202. In various embodiments, a conductor pin connects to waveguide connector 200 via insertion into receptacle component 204. In various embodiments, a waveguide connects to waveguide connector 200 by slotting into cavity 212 on the waveguide interface side of body 202. In the example illustrated, cavity 212 is rectangular in shape, which allows for rectangular waveguides to slot into cavity 212. It is also possible for cavity 212 to be different shapes (e.g., cylindrical to accommodate circular waveguides or elliptic cylindrical to accommodate elliptical waveguides). The size of cavity 212 can also vary to accommodate various waveguides.

In the example illustrated, cavity 212 includes impedance transformation structure 214. In various embodiments, impedance transformation structure 214 transforms electrical impedances. In some embodiments, impedance transformation structure 214 is created from a same original block of material as body 202. For example, impedance transformation structure 214 may be created by excavating body 202 to create cavity 212 such that impedance transformation structure 214 remains. In the example of waveguide connector 200, impedance transformation structure 214 has a staircase shape (also see FIG. 2B and FIG. 2D). Impedance transformation structure 214 performs an impedance transformation between the waveguide interface end of waveguide connector 200 and the coaxial conductor pin interface end of waveguide connector 200. For example, the waveguide interface end may have a relatively high characteristic impedance in the range of 190 to 750 ohms for $TE_{10}$ mode operation (such as 480 ohms) and the coaxial conductor pin interface end may have a standard 50 ohms characteristic impedance. Using 480 ohms as an example, this means the staircase shape of impedance transformation structure 214 would be designed to transform 480 ohms to 50 ohms. Impedance transformation is described in further detail below.

In the example shown, impedance transformation structure 214 includes excavated space 216 into which receptacle component 204 can be inserted. Excavated space 216 is configured to be large enough to receive receptacle component 204 (otherwise, receptacle component 204 could fracture). Excavated space 216 can vary in size for different receptacle component designs. In the example shown, back short component 206 includes depression 218 (also see FIG. 2F, which shows various views of back short component 206). In this example, depression 218 is a circular indentation surrounding aperture 210. In the example shown, body 202 includes empty region 220 into which back short component 206 can be fitted. For example, back short component 206 may be press fitted into empty region 220 to couple back short component 206 to body 202. In this example, empty region 220 is circular in shape to accommodate a circular back short component 206. In the example shown, body 202 includes a plurality of mounting holes (e.g., mounting hole 222). In the example shown, there are four mounting holes (the mounting holes being the smaller holes). Screws, pins, or other fastening components may be inserted through the mounting holes to fasten waveguide connector 200 to a housing of an RF component (e.g., antenna, amplifier, frequency converter, switch, attenuator, oscillator, etc.). Some embodiments do not include mounting holes. In the example shown, body 202 includes a plurality of flange holes (e.g., flange hole 224). In the example shown, there are two sets of four flange holes (total of eight flange holes). Pins may be inserted through a set of flange holes to fasten waveguide connector 200 to a waveguide. Different sets of flange holes may be used to accommodate different locations of index holes on different waveguides. The number and locations of mounting and/or flange holes in this example is merely illustrative. Mounting and/or flange hole configuration can vary to accommodate attachment to different waveguides and/or RF components.

Figure 2B:
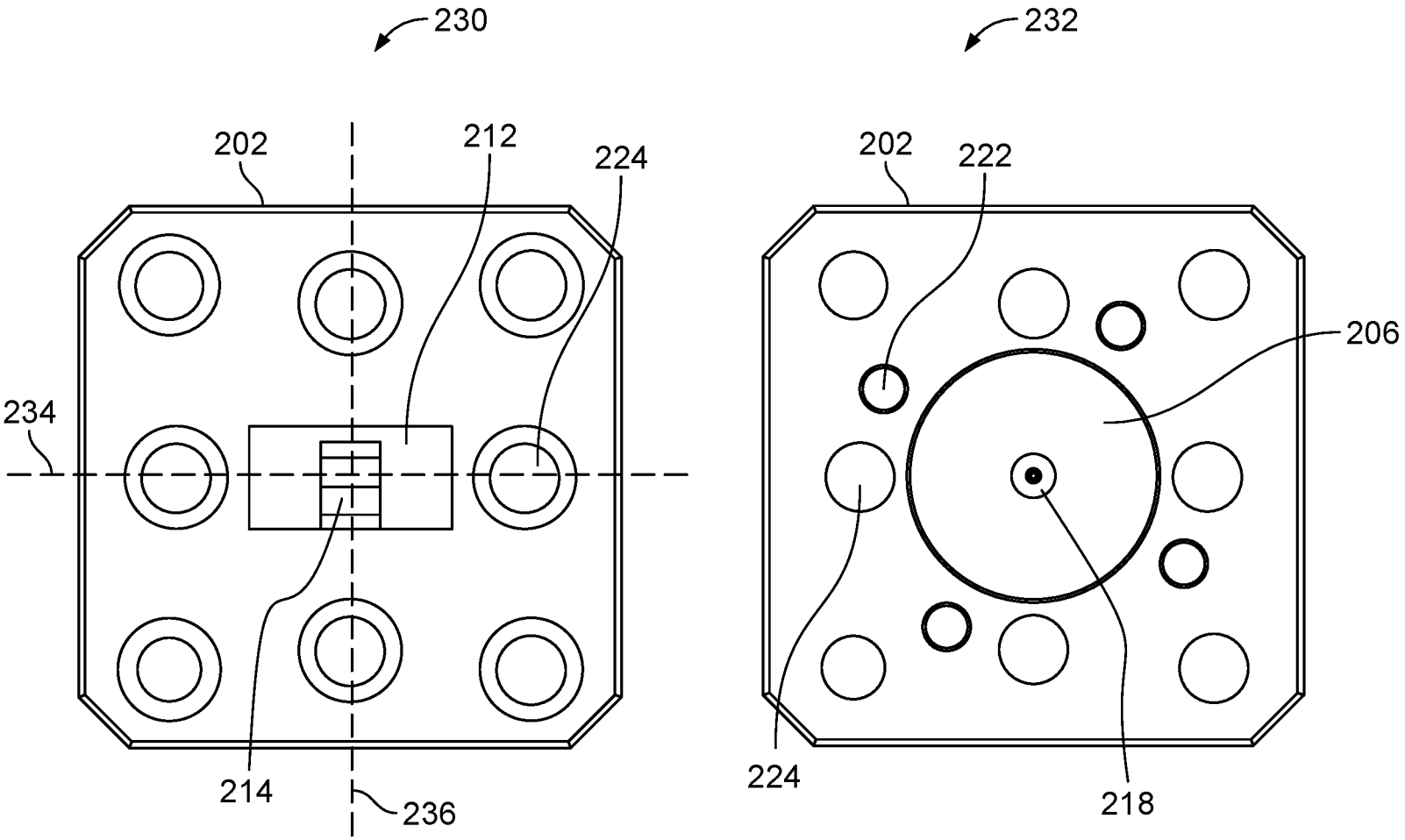
Figure 2C:
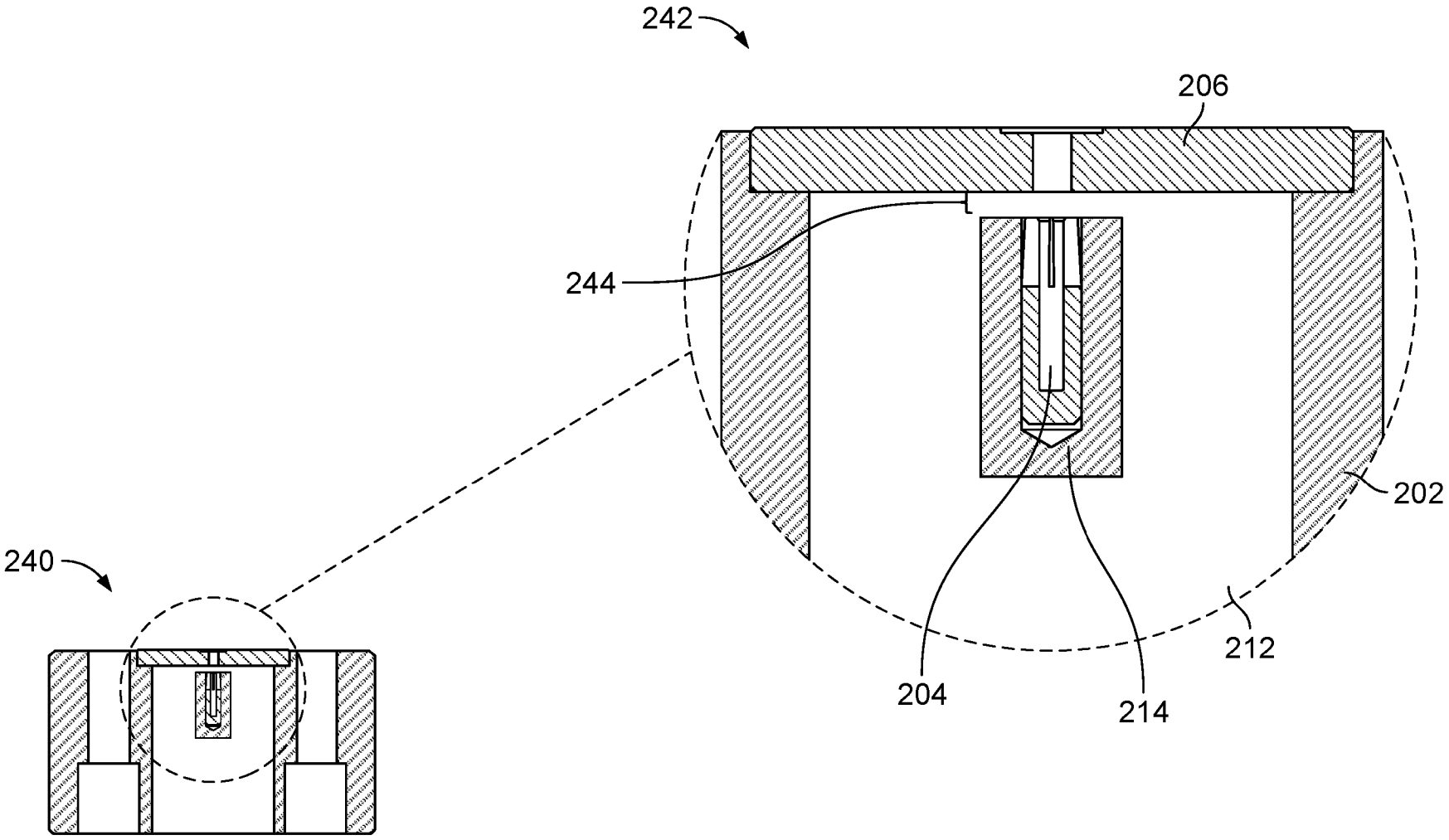
Figure 2D:
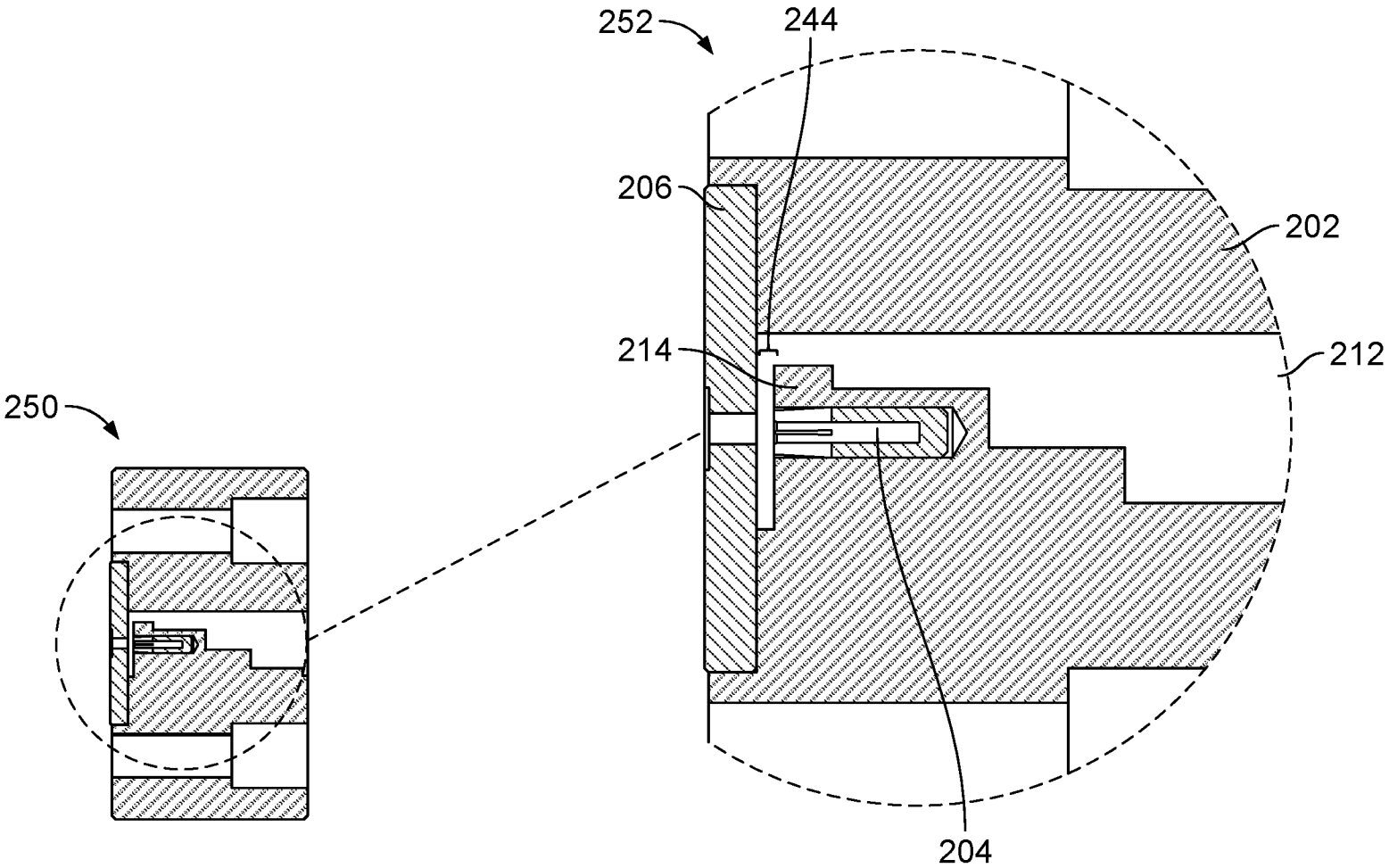

FIG. 2B shows front and back straight on views of waveguide connector 200. View 230 shows waveguide connector 200 from the perspective of a waveguide looking toward the waveguide interface of waveguide connector 200. View 232 shows waveguide connector 200 from the perspective of an RF component looking toward the coaxial conductor pin interface of waveguide connector 200. In view 230, body 202, cavity 212, impedance transformation structure 214, and flange holes (including flange hole 224) can be seen. As can also be seen in FIG. 2A, cavity 212, in this case, is shaped to couple to a rectangular waveguide. Cross sections 234 and 236 are shown in FIG. 2C and FIG. 2D, respectively. In view 232, body 202, mounting holes (including mounting hole 222), flange holes (including flange hole 224), and back short component 206 (including depression 218) can be seen. In view 232, pins are shown in the mounting holes (pins not shown in FIG. 2A). As shown in views 230 and 232, flange holes (but not mounting holes), completely extend through body 202 of waveguide connector 200. The other side of back short component 206 can be seen in view 230 (not labelled in view 230) as the background object behind impedance transformation structure 214 in cavity 212. As shown, back short component 206 covers cavity 212 on the coaxial conductor pin interface side. In view 232, a portion of receptacle component 204 (not labelled in view 232) can be seen through aperture 210 (not labelled in view 232) of back short component 206.

FIG. 3C shows a view of cross section 234 of FIG. 2B. View 240 is a portion of cross section 234, and view 242 shows a magnified portion of view 240. In view 242, body 202, receptacle component 204, back short component 206, cavity 212, and impedance transformation structure 214 can be seen. In the example illustrated, gap 244 exists between back short component 206 and impedance transformation structure 214.

FIG. 2D shows a view of cross section 236 of FIG. 2B. View 250 is a portion of cross section 236, and view 252 shows a magnified portion of view 250. In view 252, body 202, receptacle component 204, back short component 206, cavity 212, and impedance transformation structure 214 can be seen. In the example illustrated, gap 244 exists between back short component 206 and impedance transformation structure 214. In the example shown, gap 244 is a gap between the highest step of a staircase structure and where back short component 206 couples to body 202.

As shown in view 252, impedance transformation structure 214 has a staircase shape. Impedance transformation structure 214 may be regarded as a multi-stage quarter-wave matching transmission line series. In this example, the dimensions of the staircase (e.g., number of steps, width of steps, height of steps, distance of gap 244, etc.) affect impedance matching between the coaxial conductor pin interface and the waveguide interface. An electromagnetic (EM) simulator that performs finite element analysis to find numerical solutions to differential equations may be used to model the impedance matching and determine the number of steps, width of steps, height of steps, and distance of gap 244 in impedance transformation structure 214. Examples of EM simulation tools that may be used include HFSS (High Frequency Structure Simulator) and CST (Computer Simulation Technology). In various embodiments, the width of the steps is determined at least in part based on mechanical considerations. For example, width of the steps may be based on strength and stability considerations because steps that are not sufficiently wide may break upon receiving receptacle component 204. In terms of electrical considerations, steps that are overly wide may result in impedances of the steps being too low to adequately accomplish the desired impedance transformation (e.g., from 480 ohms to 50 ohms in the example given above). Stated alternatively, with respect to the impedance transformation example given above, the steps would need to be wide enough to stably receive receptacle component 204 but narrow enough to correspond to impedance values between 480 ohms and 50 ohms. Determining the number of steps also entails balancing mechanical and electrical tradeoffs. A greater number of steps (corresponding to finer gradations between steps) may be associated with electrical performance benefits (e.g., in terms of bandwidth performance) but is also more difficult to fabricate. Furthermore, a greater number of steps may increase the overall length of waveguide connector 200 beyond an acceptable value. In various embodiments, the number of steps, width of steps, height of steps, distance of gap 244, and other dimensions and/or parameters of impedance transformation structure 214 are determined via iterative design (e.g., using EM simulator tools) and taking into account mechanical and electrical constraints.

Figure 2E:
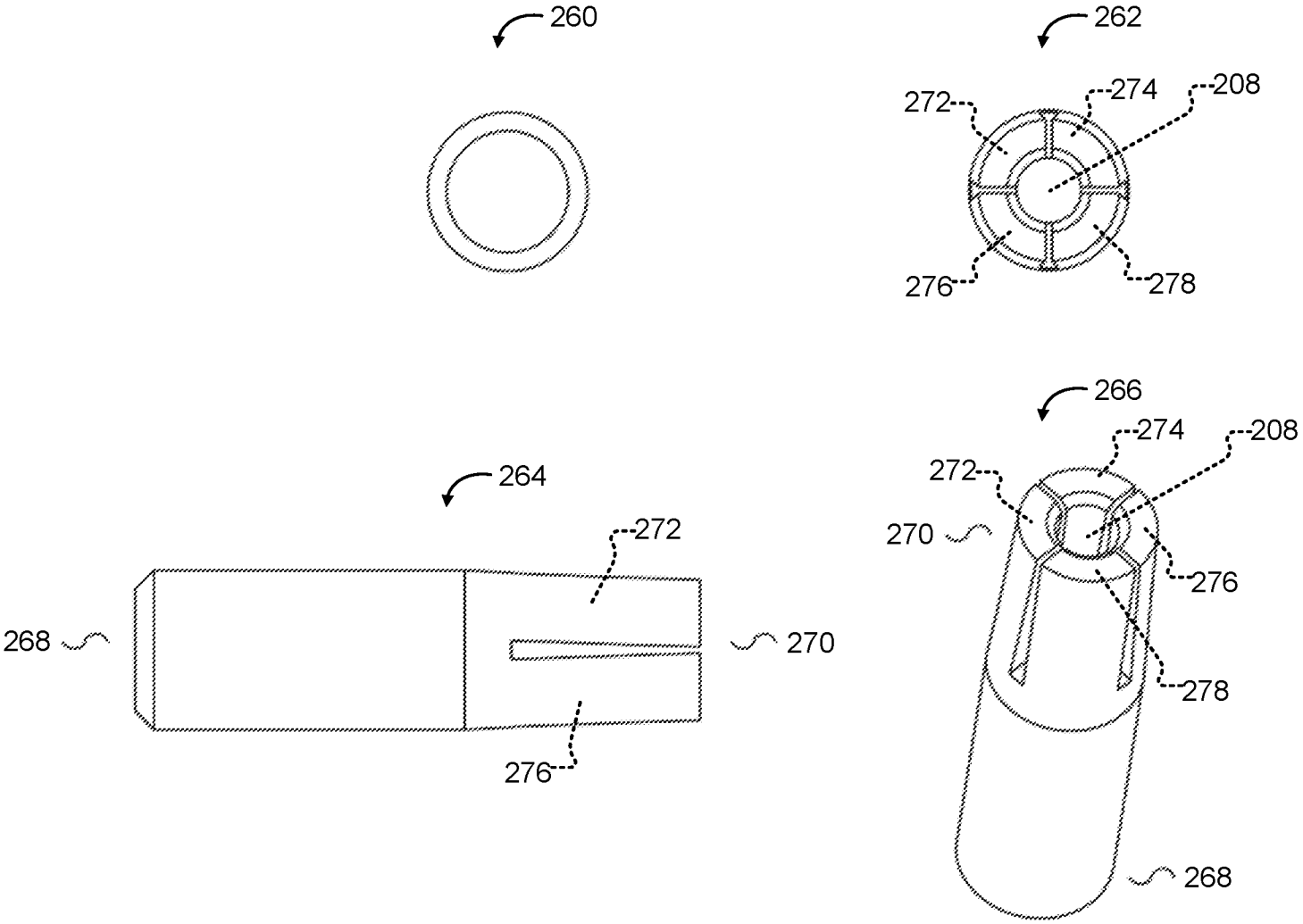

FIG. 2E shows various views of receptacle component 204. View 260 shows receptacle component 204 straight on from the perspective of flat end 268. As shown in FIGS. 2A, 2C, and 2D, flat end 268 is the end of receptacle component 204 that is furthest away from back short component 206. View 262 shows receptacle component 204 straight on from the perspective of tapered end 270. As shown in FIGS. 2A, 2C, and 2D, tapered end 270 is the end of receptacle component 204 that is nearest to back short component 206. View 264 shows receptacle component 204 from a side perspective. View 266 shows receptacle component 204 from an angled perspective. Opening 208 can be seen in views 262 and 266.

In the example shown, four finger-like segments (tapered segments 272, 274, 276, and 278) of receptacle component 204 are located on tapered end 270 around opening 208. In the example shown, gaps of space exist between the tapered segments. Tapering can be seen in view 264, which shows tapered segments 272 and 276. In some embodiments, tapering is achieved by utilizing a lathe to progressively shave more of receptacle component 204 going in the direction toward tapered end 270. In some embodiments, the portion of receptacle component 204 along flat end 268 is solid. In some embodiments, the inner portion of receptacle component 204 along tapered end 270 is hollow. In the example shown, flat end 268 is the end that is inserted into excavated space 216 of impedance transformation structure 214. Making receptacle component 204 solid on this end increases the stability of fit of receptacle component 204 in excavated space 216. The example shown is merely illustrative. It is possible for receptacle component 204 to have a different number of tapered segments (e.g., two, three, etc.) and/or different dimensions, or otherwise be configured differently.

In various embodiments, the tapered segments of receptacle component 204 fit securely around a standardized coaxial conductor pin. Receptacle component 204 can be sized to accommodate standard size conductor pins, such as a conductor pin with a diameter of 0.012 inches (also referred to as 12 mil, wherein 1 mil is equal to a thousandth of an inch). Tapering of receptacle component 204 facilitates a tight fit with the conductor pin, preventing the conductor pin from coming loose during movement, vibrations, etc. and promoting solid electrical contact with the conductor pin. The tight fit reduces the chance of unstable signal transmission. In various embodiments, to achieve the tight fit, opening 208 has a smaller diameter than the conductor pin. For example, opening 208 may be 0.010 inches in diameter for a conductor pin with a diameter of 0.012 inches. This example is illustrative and not restrictive. Other sizes and ratios of diameters are also possible.

With opening 208 having a smaller diameter than the conductor pin, tapered segments 272, 274, 276, and 278 flex outwards. The gaps between the tapered segments enhance the flexibility of the tapered segments, reducing the chance that they break. These gaps may be produced by machining away portions of tapered end 270 of receptacle component 204. Tapering gives the tapered segments room to flex outward. In various embodiments, receptacle component 204 is excavated (in its center portion at tapered end 270) to an appropriate depth to accommodate the conductor pin, e.g., to accommodate different lengths of different conductor pins. The example shown is illustrative and not restrictive. Different receptacle structures to securely connect to a conductor pin are also possible.

Figure 2F:
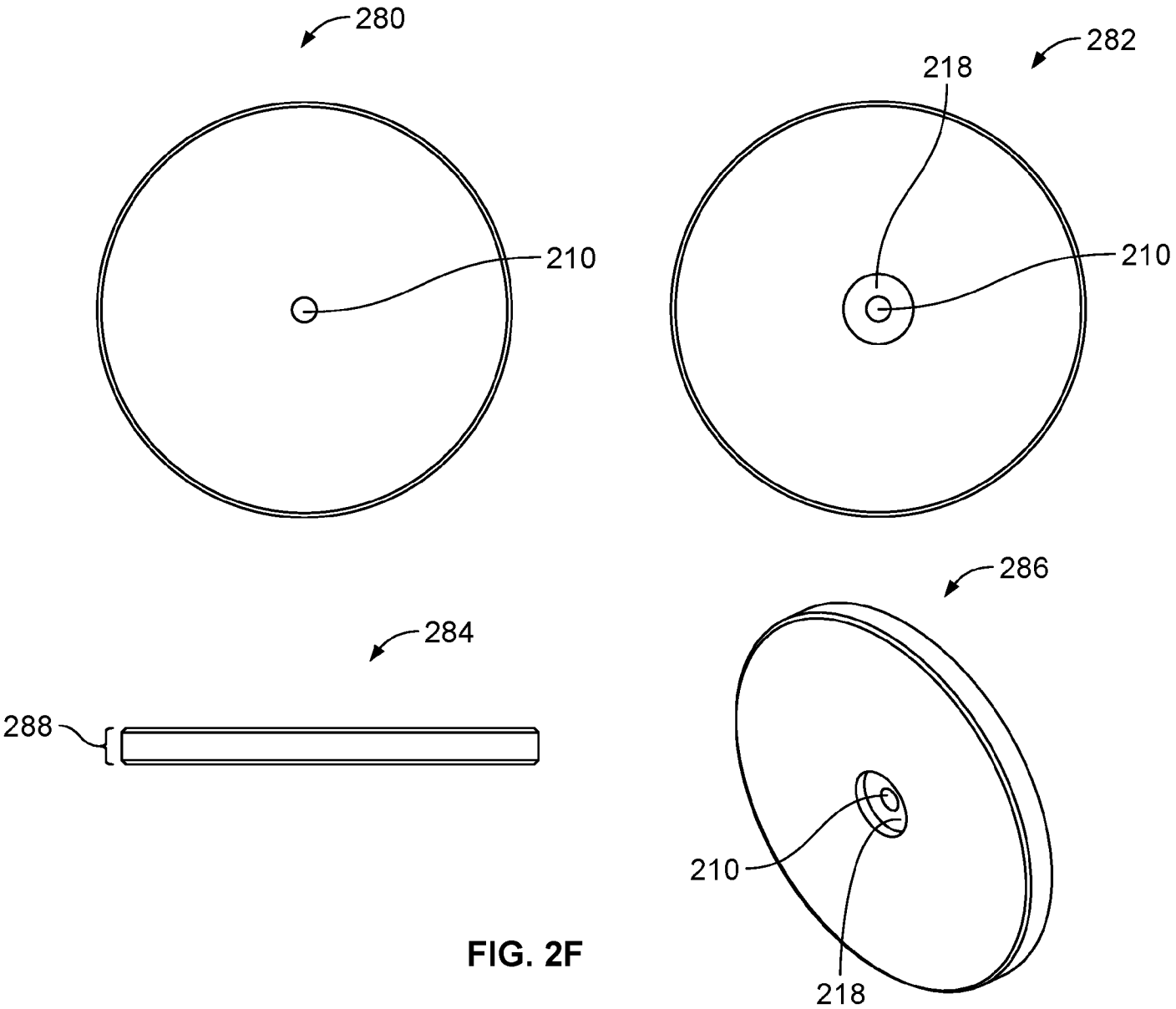

FIG. 2F shows various views of back short component 206. Views 280 and 282 show back short component 206 straight on. View 280 shows the side of back short component 206 that faces toward body 202. As shown in view 280, this side is flat. View 282 shows the side of back short component 206 that faces away from body 202. As shown in view 282, this side includes depression 218. View 284 shows back short component 206 from a side perspective. Thickness 288 of back short component 206 can be discerned in view 284. View 286 shows back short component 206 from an angled perspective. The three-dimensional nature of depression 218 can be discerned in view 286. Aperture 210 can be seen in views 280, 282, and 286.

In the example shown, depression 218 is a ring-shaped step depression around aperture 210. Aperture 210 can vary in size to accommodate different designs for receptacle component 204. Aperture 210 is large enough for receptacle component 204 to pass through. In various embodiments, back short component 206 plays a role in impedance matching an RF component (e.g., RF component 106 of FIG. 1) to waveguide connector 200. Impedance matching promotes effective signal transmission from the RF component via a conductor pin to waveguide connector 200 and vice versa. In some embodiments, back short component 206 impedance matches to 50 ohms, which is a typical characteristic impedance of a standardized conductor pin. Various other specified impedances that are commonly used are also possible, e.g., 75 ohms, 300 ohms, and other values. The dimensions (e.g., diameter and depth) of depression 218 affect the impedance matching. These dimensions may be determined to achieve a specified impedance match (performing an impedance transformation) by utilizing an EM simulator that performs finite element analysis to find numerical solutions to differential equations (e.g., HFSS, CST, etc.). The process of impedance matching may also be aided by utilizing a Smith chart. In various embodiments, impedance matching is performed with respect to a conductor pin of a standardized size (e.g., 0.012 inches in diameter or other standard sizes). In various embodiments, back short component 206 is fabricated to be mechanically compact but also stiff enough that it does not deform when coupling (e.g., via press-fitting) with other components. Stiffness of back short component 206 is based at least in part on thickness 288 (increased thickness corresponds to increased stiffness). The example shown is illustrative and not restrictive. It is also possible for back short component 206 and/or aperture 210 to have different shapes and/or dimensions.

In some embodiments, body 202, receptacle component 204, and back short component 206 are fabricated using computer numerical control (CNC) milling and wire electrical discharge machining (wire EDM). Wire EDM may be utilized to create sharp corners. For example, wire EDM may be utilized to cut out cavity 212 in body 202. CNC milling may be utilized to carve out impedance transformation structure 214 (e.g., a staircase structure). CNC milling may be utilized to create empty region 220 of body 202 into which back short component 206 fits. CNC milling or lathe machining may be utilized to create excavated space 216, mounting holes of body 202 (e.g., mounting hole 222), and/or flange holes of body 202 (e.g., flange hole 224). CNC milling or lathe machining may be utilized to create aperture 210 and depression 218 of back short component 206. CNC milling or lathe machining may be utilized to excavate a hollow portion from tapered end 270 of receptacle component 204. Tapering of receptacle component 204 may be machined with a lathe or mill. For receptacle component 204, an example machining process includes starting with a solid cylinder, tapering an end, hollowing out the center of the tapered end to a specified depth, and cutting out slots (gaps) from the tapered end to form a plurality of finger-like structures.

Figure 3A:
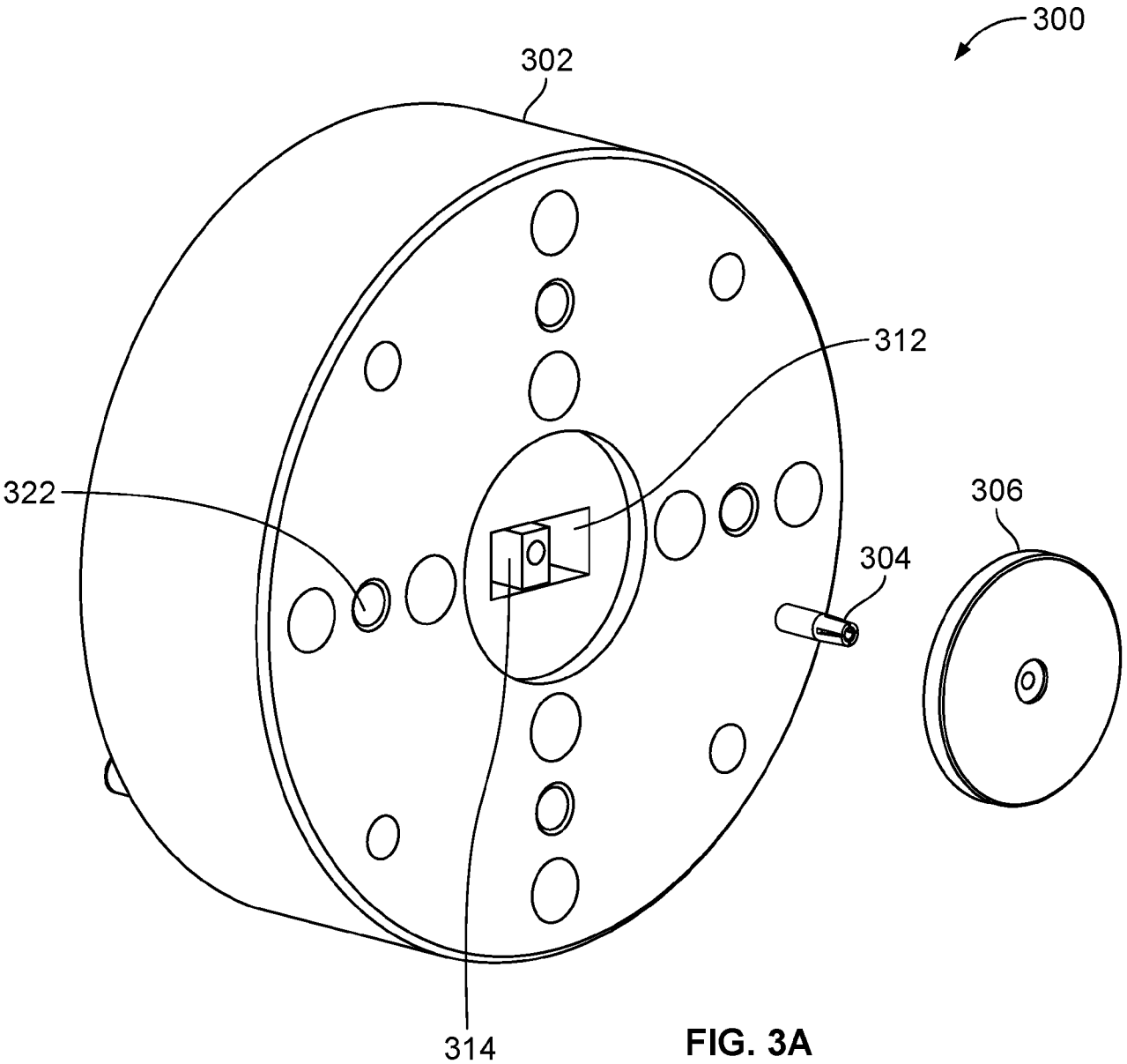
FIGS. 3A - 3B are diagrams depicting various views of another embodiment of a waveguide to coaxial conductor pin connector.
Figure 3B:
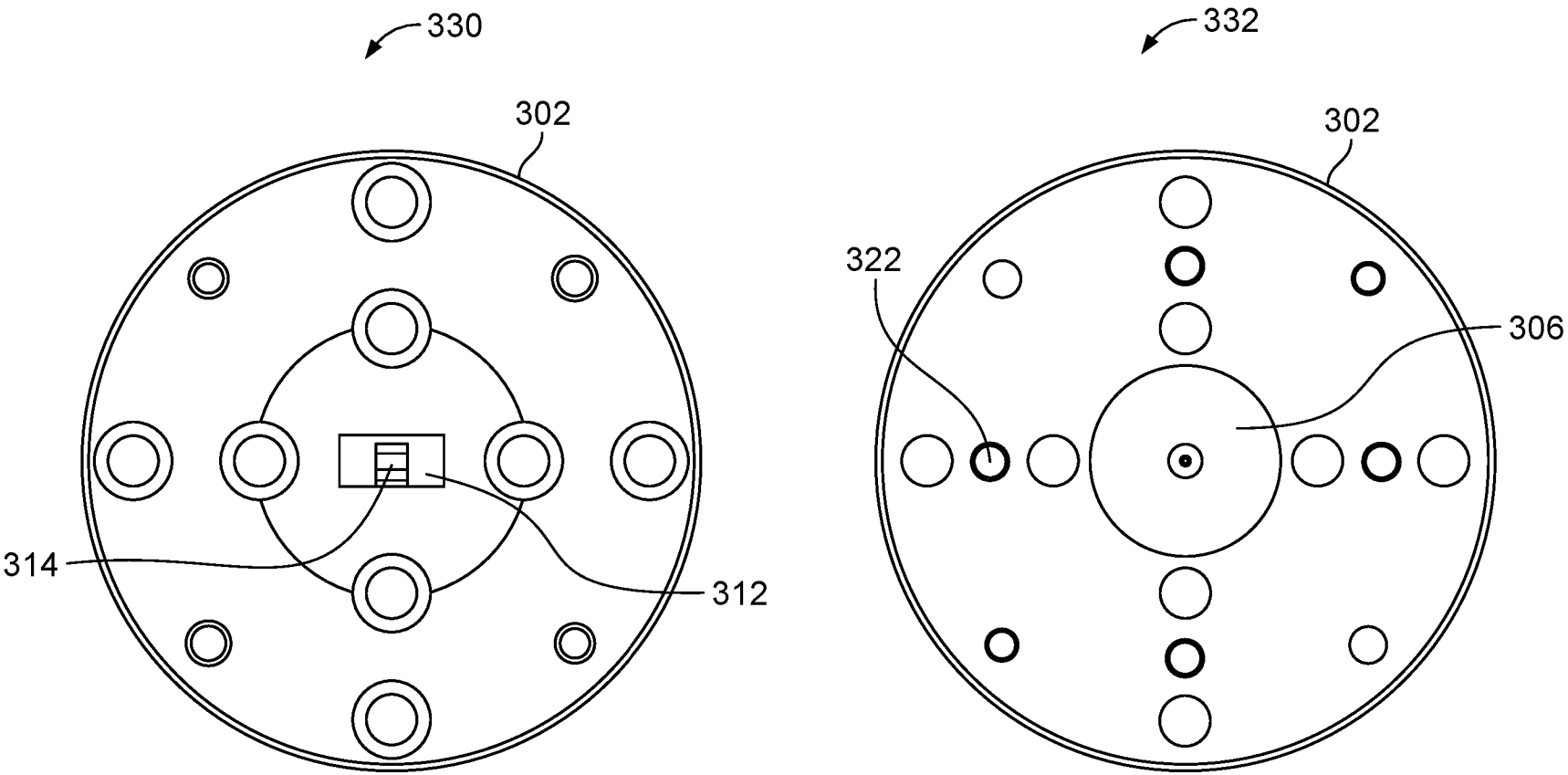

FIGS. 3A - 3B are diagrams depicting various views of another embodiment of a waveguide to coaxial conductor pin connector. The waveguide connector illustrated in FIGS. 3A - 3B may be utilized in system 100 as waveguide connector 104 to connect waveguide 102 to RF component 106.

FIG. 3A is a three-dimensional exploded view diagram of waveguide connector 300. In the example illustrated, waveguide connector 300 includes body 302, receptacle component 304, and back short component 306. The relationship among body 302, receptacle component 304, and back short component 306 of waveguide connector 300 is analogous to the relationship among body 202, receptacle component 204, and back short component 206 of waveguide connector 200 of FIGS. 2A - 2F. In some embodiments, receptacle component 304 is the same as or substantially similar to receptacle component 204. In some embodiments, back short component 306 is the same as or substantially similar to back short component 206. Thus, further discussion of receptacle component 304 and back short component 306 is not given (see description associated with FIGS. 2A - 2F for further details regarding receptacle and back short components).

In various respects, body 302 is the same as or substantially similar to body 202 of waveguide connector 200 of FIGS. 2A - 2F. For example, body 302 includes cavity 312 and impedance transformation structure 314, analogous to cavity 212 and impedance transformation structure 214. As with cavity 212, cavity 312 varies in size to accommodate connection to different waveguides. As with the dimensions of impedance transformation structure 214 and other aspects of waveguide connector 200′s design, the dimensions of impedance transformation structure 314 and other aspects of waveguide connector 300′s design may be determined by utilizing an EM simulator. Further discussion of the similarities between waveguide connector 200 of FIGS. 2A—2F and waveguide connector 300 is not given (see description associated with FIGS. 2A - 2F for further details regarding aspects of waveguide connector 300 that are analogous to corresponding aspects of waveguide connector 200).

A prominent difference between body 302 and body 202 of waveguide connector 200 is that body 302 is cylindrical in shape, whereas body 202 is rectangular in shape. A consequence of the round shape of body 302 is different location options for mounting, flange, or other holes. Such holes may be placed according to a radial as opposed to rectilinear pattern. In the example shown, body 302 includes a plurality holes that may be utilized for attaching an RF component (e.g., antenna, amplifier, frequency converter, switch, attenuator, oscillator, etc.) and/or waveguide to waveguide connector 300. For example, the ring of four holes (e.g. hole 322) between the innermost ring of four holes and outermost ring of eight holes may be utilized to fasten an RF component to waveguide 300. In some embodiments, multiple sets of flange holes are present in order to accommodate different locations of index holes on different waveguides. The number and locations of holes in this example are merely illustrative. Hole configuration can vary to accommodate attachment to different waveguides and/or RF components.

FIG. 3B shows front and back straight on views of waveguide connector 300. View 330 shows waveguide connector 300 from the perspective of a waveguide looking toward a waveguide interface of waveguide connector 300. View 332 shows waveguide connector 300 from the perspective of an RF component looking toward a coaxial conductor pin interface of waveguide connector 300. In view 330, body 302, cavity 312, impedance transformation structure 314, and various holes can be seen. As can also be seen in FIG. 3A, cavity 312, in this case, is shaped to couple to a rectangular waveguide. In view 332, body 302, back short component 306, and various holes, including holes for attaching an RF component, e.g., hole 322, can be seen. In view 332, pins are shown in the holes for attaching an RF component (pins not shown in FIG. 3A). As shown in views 330 and 332, various holes (but not holes for attaching an RF component), completely extend through body 302 of waveguide connector 300. The other side of back short component 306 can be seen in view 330 (not labelled in view 330) as the background object behind impedance transformation structure 314 in cavity 312. As shown, back short component 306 covers cavity 312 on the coaxial conductor pin interface side. In view 332, a portion of receptacle component 304 (not labelled in view 332) can be seen behind back short component 306. For further details regarding the relationships between various components, see the description associated with the embodiment shown in FIGS. 2A - 2F.

The disclosed waveguide connector (e.g., the embodiments shown in FIGS. 2A -2F and FIGS. 3A - 3B) can be conceptualized as part of a series of transmission lines: a coaxial transmission line (conductor pin and connection to an RF component), a rigid waveguide (impedance transformation structure of the body of the waveguide connector), and a standard waveguide. In various embodiments, design constraints associated with the waveguide connector are a result of the coaxial part of this transmission line series being standardized. For example, the characteristic impedance $Z_o$ of a coaxial line is often already specified (e.g., a 50 ohms standard), which constrains the outer conductor diameter D and inner diameter d of the coaxial line according to the relationship $$Z_o = \frac{138}{\sqrt{\varepsilon_r}} \log \frac{D}{d},$$

where $\varepsilon_r$ is the dielectric constant. A further constraint is that $$D + d \leq \frac{2\lambda_o}{\pi\sqrt{\varepsilon_r}}$$

in order for the dominant mode of the coaxial line to be the transverse electromagnetic (TEM) mode at the operating wavelength $\lambda_o$. Operating wavelength $\lambda_o$ (meters) is given by c/f, where the f is the frequency (MHz) and c is the speed of the light (299,792,458 meters/second). Waveguide connectors may be designed to operate over various frequency bands, e.g., various frequency bands in a frequency range, for example, from 8.2 GHz to 110 GHz.

The disclosed waveguide connector (e.g., the embodiments shown in FIGS. 2A -2F and FIGS. 3A - 3B) may operate over various frequency bands. In some embodiments, the disclosed waveguide connector operates over a frequency range from 26.5 GHz to 40.0 GHz. In some embodiments, example parameters associated with the disclosed waveguide connector include: insertion loss of 0.5 dB, return loss of 20 dB, power handling of 100 W (CW), specification temperature of +25° C., and operating temperature range between -40° C. to +85° C. As another example, parameters may include: operation over a frequency range from 40 GHz to 60 GHz, insertion loss of 0.9 dB, return loss of 20 dB, power handling of 100 W (CW), specification temperature of +25° C., and operating temperature range between -40° C. to +85° C. Specific parameters vary based on specific waveguide connector designs. The examples listed above are merely illustrative.

In some embodiments, the disclosed waveguide connector is connected to a power amplifier (e.g., a U-band amplifier). Example electrical specifications and performance characteristics associated with the power amplifier may be: frequency range from 40 GHz to 60 GHz, typical gain of 15 dB, typical $P_{1dB}$ of +19 dBm, typical $P_{SAT}$ of +20 dBm, maximum $P_{in}$ of +23 dBm, typical input return loss of 10 dB, typical output return loss of 10 dB, DC voltage range from +6 $V_{DC}$ to + 15 $V_{DC}$ (with a typical voltage of + 8 $V_{DC}$), typical DC supply current (quiescent) of 300 mA, typical specification temperature of + 25° C., and operating temperature range between 0° C. and +50° C. Specific power amplifier parameters vary based on the designs of the specific power amplifiers. A variety of power amplifiers with a variety of parameters may be connected to the disclosed waveguide connector. The above example is illustrative and not restrictive.

Figure 4A:
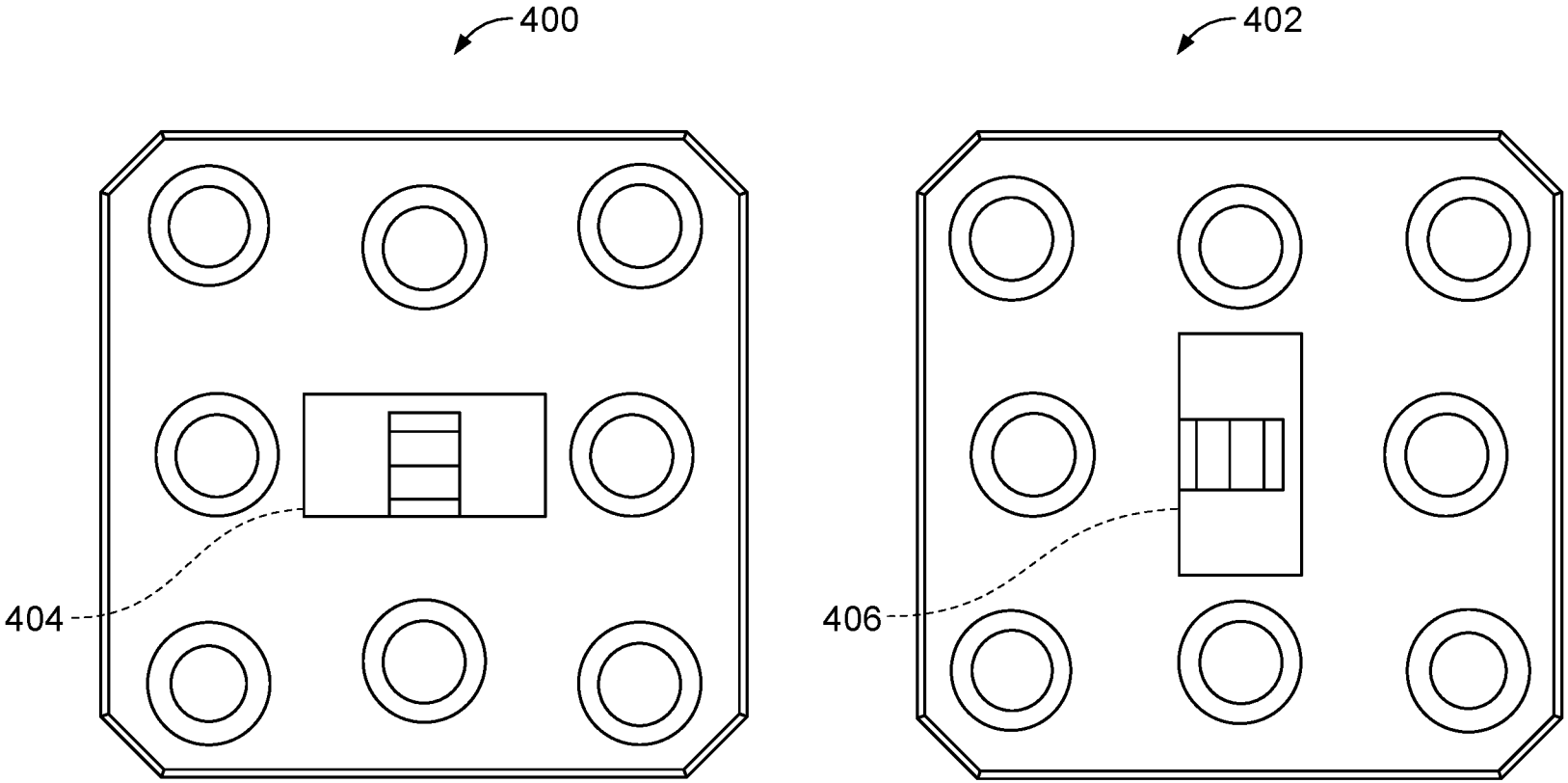
FIGS. 4A - 4B are diagrams depicting orientation twisting of waveguide to coaxial conductor pin connectors.
Figure 4B:
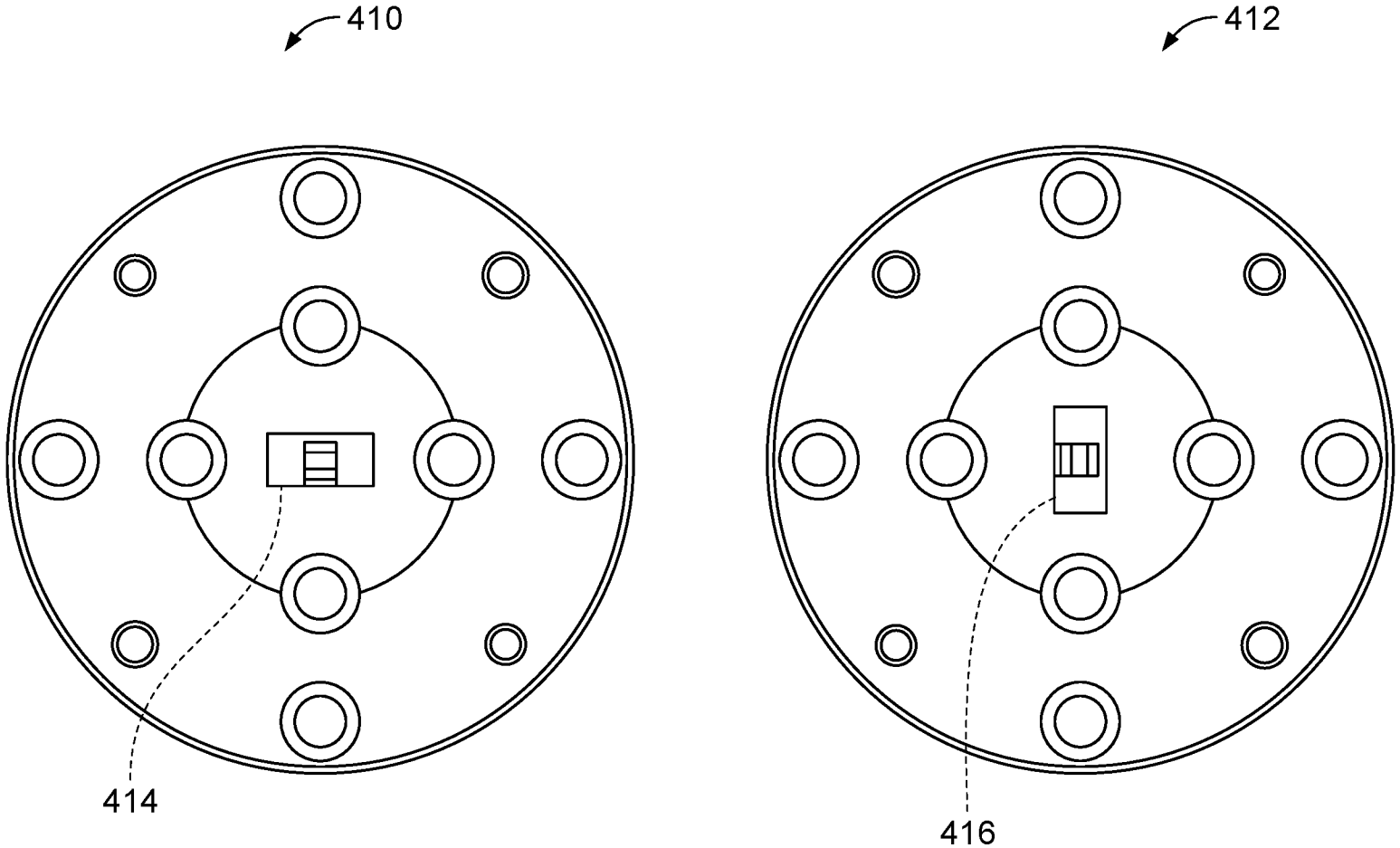

FIGS. 4A - 4B are diagrams depicting orientation twisting of waveguide to coaxial conductor pin connectors. In various scenarios, a waveguide connector may be twisted into multiple orientations to accommodate system needs. For example, an RF component, such as an amplifier, may require the waveguide connector to be positioned in a specified orientation in order to couple to a port of the RF component. Twisting allows for changing the orientation of the electric field in a waveguide connector / waveguide (e.g., from vertical to horizontal or vice versa). FIG. 4A shows waveguide connector 200 of FIGS. 2A - 2F in two orientations. View 400 shows waveguide connector 200 in a vertical orientation, as indicated by vertical orientation 404 of its central cavity. View 402 shows waveguide connector 200 in a horizontal orientation, as indicated by horizontal orientation 406 of its central cavity. FIG. 4B shows waveguide connector 300 of FIGS. 3A - 3B in two orientations. View 410 shows waveguide connector 300 in a vertical orientation, as indicated by vertical orientation 414 of its central cavity. View 412 shows waveguide connector 300 in a horizontal orientation, as indicated by horizontal orientation 416 of its central cavity.

In various embodiments, the number of mounting holes of the waveguide connector (e.g., to fasten an RF component) affects twisting of the waveguide connector. The twisting shown in FIGS. 4A and 4B is achieved by rotating the waveguide connector 90 degrees. Two waveguide connectors (in an overall system) can be aligned orthogonally with respect to each other by twisting one waveguide connector 90 degrees relative to the other. Mounting holes are positioned in the waveguide connectors such that mounting holes of the first waveguide connector align with mounting holes of the second waveguide connector. To allow for twisting of 90 degrees, four mounting holes can be positioned 90 degrees apart so that all 90-degree orientations mount in the same way. Allowing for any 90-degree orientation enhances flexibility, which may be needed if there are connection orientation constraints. Such an approach avoids a need for a separate twist element to connect a waveguide connector of one orientation to an RF component or a waveguide of another orientation. As an example, an RF component (e.g., an amplifier) may have an input port to which a first waveguide connector is attached in a horizontal orientation and an output port to which a second waveguide connector is attached in a vertical orientation.

Waveguide connectors may be connected back-to-back. For example, with the capability to twist 90 degrees, two identical waveguide connectors may be connected back-to-back such that the first waveguide connector is horizontally aligned, and the second waveguide connector is vertically aligned. Back-to-back waveguide connectors may be utilized in scenarios in which one end of the back-to-back waveguide connectors combination connects to a first component in a first orientation and the other end connects to a second component in a second orientation. In such scenarios, more than one waveguide connector is required.

Twisting by different angles (other than 90 degrees) is also possible. Twisting by an arbitrary angle can be achieved by utilizing an appropriate number of mounting holes equally spaced apart in degrees. For example, to be able to twist in 10-degree increments, 36 mounting holes can be positioned on a connector body (360 degrees divided by 36 orientations equals 10-degree spacing between orientations). In some embodiments, steel balls (e.g., grooved into mounting holes) or another mechanism are utilized to facilitate turning, providing adjustable twisting without a need to unmount and remount the waveguide connector.

Figure 5:
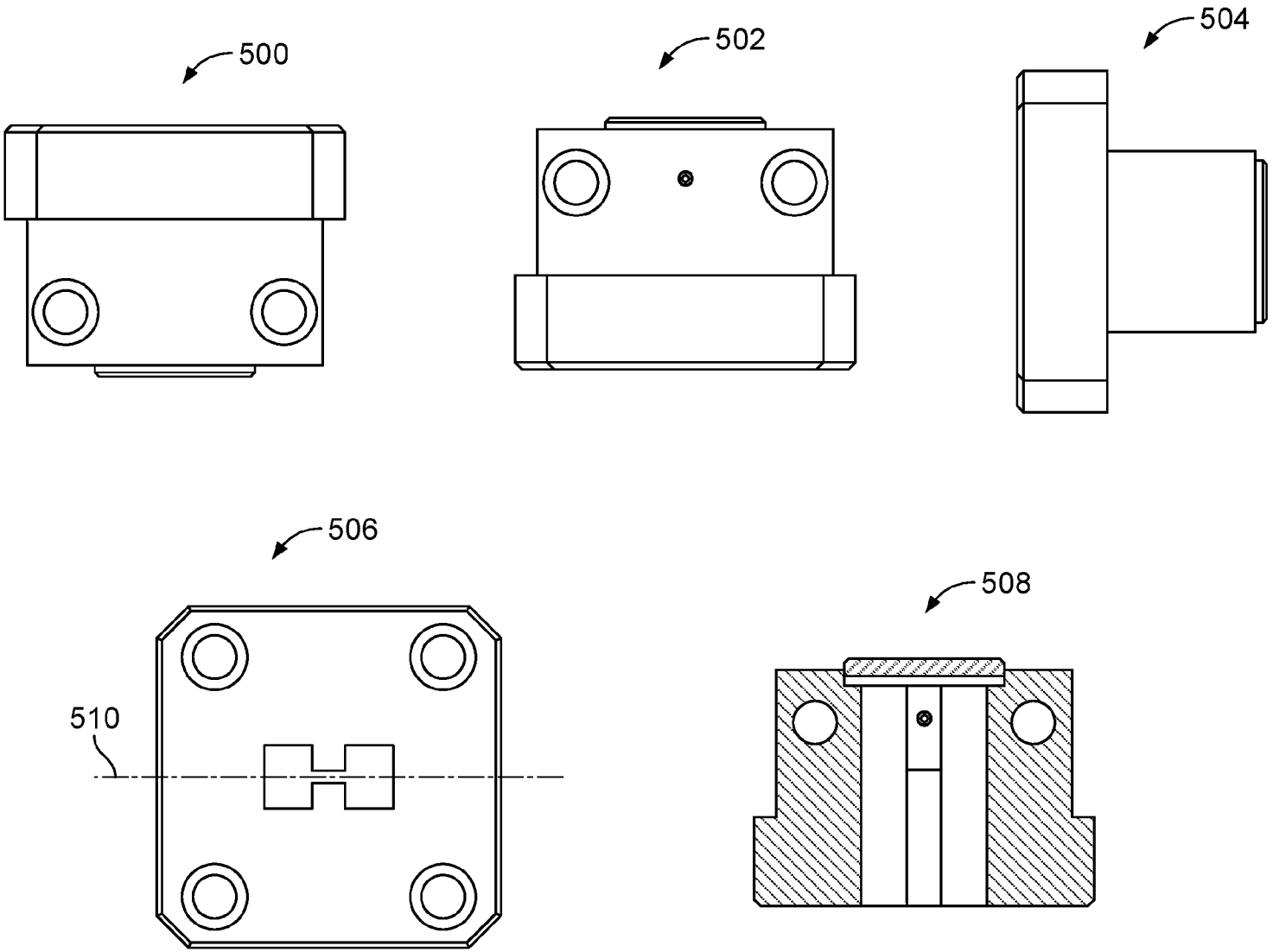
FIG. 5 is a diagram depicting various views of an embodiment of a double ridge waveguide to coaxial conductor pin connector.

FIG. 5 is a diagram depicting various views of an embodiment of a double ridge waveguide to coaxial conductor pin connector. Views 500, 502, 504, 506, and 508 illustrate extension of a waveguide connector to a double ridge design. A double ridge design can extend waveguide operation frequency coverage. For example, a WR-28 rectangular waveguide can cover a range from 26.5 GHz to 40 GHz while a WRD180 double ridge waveguide can cover a range from 18 GHz to 40 GHz. In the example shown, view 508 corresponds to cross section 510 of view 506.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A connector for connecting a waveguide and a coaxial conductor pin, comprising:
- a body, wherein the body includes a first interface configured to couple to the waveguide and a second interface configured to couple to the coaxial conductor pin;
- a cavity within the body, wherein the cavity takes up a region between the first interface and the second interface; and
- an impedance transformation structure located in the cavity, wherein the impedance transformation structure is configured to receive a receptacle component that is configured to receive the coaxial conductor pin, wherein the receptacle component includes:
  - a first portion that is at least substantially solid and configured to couple to the impedance transformation structure; and
  - a second portion that includes an inner hollow portion that is surrounded by a plurality of segments separated from one another by a corresponding plurality of gaps between segments.

2. The connector of claim 1, wherein the impedance transformation structure has a staircase shape in which a series of steps ascend toward the second interface.

3. The connector of claim 1, wherein the impedance transformation structure includes an excavated space facing the second interface that is configured to receive the coaxial conductor pin.

4. The connector of claim 1, wherein a segment of the plurality of segments is progressively reduced in thickness along a direction pointing from the first portion to the second portion.

5. The connector of claim 1, wherein the body is made at least in part of aluminum or brass.

6. The connector of claim 1, wherein the body has a square or rectangular shape.

7. The connector of claim 1, wherein the body has a circular or elliptical shape.

8. The connector of claim 1, wherein the body includes a plurality of holes that are configured to receive fastening components.

9. The connector of claim 1, wherein the cavity has a rectangular shape.

10. The connector of claim 1, wherein the coaxial conductor pin is a part of a circuit that includes an electronic amplifier.

11. A connector for connecting a waveguide and a coaxial conductor pin, comprising:
- a body, wherein the body includes a first interface configured to couple to the waveguide and a second interface configured to couple to the coaxial conductor pin;
- a cavity within the body, wherein the cavity takes up a region between the first interface and the second interface; and
- an impedance transformation structure located in the cavity; wherein:
  - the impedance transformation structure is configured to receive a receptacle component that is configured to receive the coaxial conductor pin;
  - the receptacle component includes an opening that is configured to receive the coaxial conductor pin and has a diameter less than a diameter of the coaxial conductor pin;
  - the second interface includes a segment that is located a gap of space apart from the impedance transformation structure and covers a side of the cavity except for an aperture configured to allow through the coaxial conductor pin; and
  - the segment has a circular shape.

12. A connector for connecting a waveguide and a coaxial conductor pin, comprising:
- a body, wherein the body includes a first interface configured to couple to the waveguide and a second interface configured to couple to the coaxial conductor pin;
- a cavity within the body, wherein the cavity takes up a region between the first interface and the second interface; and
- an impedance transformation structure located in the cavity; wherein:
  - the second interface includes a segment that is located a gap of space apart from the impedance transformation structure and covers a side of the cavity except for an aperture configured to allow through the coaxial conductor pin; and
  - the segment includes a depression that surrounds the aperture and is located on a side furthest away from the impedance transformation structure.

13. The connector of claim 12, wherein the segment is configured to impedance match to a specified impedance of the coaxial conductor pin.

14. The connector of claim 12, wherein the segment has a circular shape.

15. The connector of claim 12, wherein the impedance transformation structure has a staircase shape in which a series of steps ascend toward the second interface.

16. A connector for connecting a waveguide and a coaxial conductor pin, comprising:
- a body, wherein:
  - the body includes a first interface configured to couple to the waveguide and a second interface configured to couple to the coaxial conductor pin; and
  - the body has a circular or elliptical shape;
- a cavity within the body, wherein the cavity takes up a region between the first interface and the second interface; and
- an impedance transformation structure located in the cavity, wherein the impedance transformation structure has a staircase shape in which a series of steps ascend toward the second interface.

* * * * *